United States Patent [19]

Tarnay

[11] Patent Number: 4,785,383

[45] Date of Patent: Nov. 15, 1988

[54] LAMP UNIT HAVING GLASS REFLECTOR MEMBER WITH MOUNT STRUCTURE

[75] Inventor: Denes Tarnay, Cleveland, Ohio

[73] Assignee: General Electric Company, Schenectady, N.Y.

[21] Appl. No.: 888,632

[22] Filed: Jul. 23, 1986

Related U.S. Application Data

[63] Continuation-in-part of Ser. No. 740,616, Jun. 3, 1985, abandoned.

[51] Int. Cl.[4] ..... H01R 33/00

[52] U.S. Cl. ..... 362/226; 362/296

[58] Field of Search ..... 362/226, 263, 296, 341, 362/347, 350

[56] References Cited

U.S. PATENT DOCUMENTS

| | | | |
|---|---|---|---|
| 1,992,041 | 2/1935 | Roper et al. | 362/350 |
| 2,086,108 | 7/1937 | Wuelker | 362/350 |
| 3,432,629 | 3/1969 | Field et al. | 362/296 |
| 3,639,750 | 2/1972 | Anthonijsz | 362/226 |
| 4,021,659 | 5/1977 | Wiley | 362/297 |
| 4,219,870 | 8/1980 | Haraden et al. | 362/226 |
| 4,376,967 | 3/1983 | Hough | 362/226 |
| 4,499,526 | 2/1985 | Tarnay | 362/350 |

*Primary Examiner*—Charles J. Myhre

*Assistant Examiner*—David A. Okonsky

*Attorney, Agent, or Firm*—Philip L. Schlamp; J. F. McDevitt; Edward M. Corcoran

[57] ABSTRACT

A molded glass reflector member for a lamp unit employing a tungsten halogen lamp as the light source is disclosed wherein the engagement means for mounting said lamp unit replaceably in a socket member includes a particular configuration of the hollow cavity portion of the said reflector member to enable improved lamp focus and physical retention of said lamp unit in its socket. Specifically, said hollow cavity end protruding from the rear side of said reflector member includes both a recessed engagement surface for mounting said lamp in the socket member so as to position the illumination emerging from said reflector member more accurately along with additional molded depressions located on opposing exterior surfaces of said elongated cavity which cooperates with said recessed engagement surface to still more accurately position the lamp in said socket member. In a preferred embodiment, the recessed opening is formed by spaced apart shoulders extending from the inner walls of the protruding hollow cavity while said elongated cavity further includes flat tapered exterior surfaces having shallow depressions therein which engage protuberances located in the socket member.

7 Claims, 1 Drawing Sheet

LAMP UNIT HAVING GLASS REFLECTOR MEMBER WITH MOUNT STRUCTURE

This application is a continuation-in-part of application Ser. No. 740,616, filed June 3, 1985 and now abandoned.

BACKGROUND OF THE INVENTION

In my earlier invention described and claimed in U.S. Pat. No. 4,499,526 there is disclosed a molded glass reflector member for a lamp unit employing a tungston halogen lamp as the light source which includes a recessed opening at its base end and which further provides an engagement surface for mounting said lamp unit in a conventional socket member. Said lamp unit has already gained popular acceptance for both horizontal and vertical mounting as a precise illumination source in such product applications as photographic projection, lighting displays, and even overhead room illumination. One conventional socket member being used for horizontal mounting of said lamp unit in a photographic projector, so that illumination therefrom proceeds in a horizontal direction, physically supports the lamp unit at the base end by a pair of lamp inlead wires while providing a metal flange at the opposite lamp end which holds the entire lamp unit in place. Vertical mounting of said lamp unit so that illumination projects therefrom in a vertically downward direction such is used in display lighting applications and overhead room illumination requires a still more reliable mounting means to avert accidental dislodgement of the lamp unit from the socket member when subjected to vibration forces and the like. It would be desirable to provide said more reliable mounting means for the lamp unit in the reflector member itself to avert increased costs attendent to fixture modification and especially if such improvement can be incorporated when the glass reflector member is initially molded. Accordingly, the present improvement constitutes a still further modification of the lamp unit disclosed in the aforementioned issued patent which is incorporated herein by reference.

An already known modification of this type lamp unit to improve its retention in the socket member utilizes a single horizontal slot formed in the elongated cavity protruding from the rear side of the reflector member and is formed therein by a sawing or grinding step after the reflector member has been molded. Such modification requires a labor intensive secondary operation and produces stress induced cracks in the glass part which are prone to propogate further enhancing glass failure. Since physical engagement of said glass slot with a mating protuberance located in the socket member will also occur only on one side of this lamp unit, there can also be tilting of the lamp unit in the socket member for improper aiming of the illumination produced therefrom. Additionally, glass chips from this slot can build up in the lamp socket after repeated lamp replacements and lead to premature socket failure with attendent higher operating costs.

SUMMARY OF THE INVENTION

It has now been discovered that providing additional molded depressions located on opposite exterior surfaces of the elongated cavity portion of the molded glass reflector member serves as an improved means to mount said lamp unit in the socket member without experiencing the aformentioned disadvantages. More particularly, said presently improved lamp unit includes a molded glass reflector member terminating at its base in an elongated hollow cavity protruding from the rear side of said reflector member, said cavity having a recessed opening of smaller size at the rearmost end formed by spaced apart shoulders extending from the inner walls of said cavity when the lamp components are assembled together which provides a recessed engagement surface for mounting said lamp, and a tungsten halogen lamp secured in said cavity so that its light source is positioned at the focal point said reflector member with the lamp inleads projecting through said recessed opening, wherein said improvement comprises additional molded depressions located on opposing exterior surfaces of said elongated cavity portion which cooperates with said recessed engagement surface to still more accurately position said lamp unit in the mount means as well as physically secure the lamp unit therein. In a preferred lamp unit construction the reflector member has a parabolic shape and the lamp component is secured in said hollow cavity entirely with adhesive cement. The recessed opening in said hollow cavity is preferably formed as a single slot through which a pair of lamp inlead wires project and said elongated cavity portion of the preferred reflector member further includes flat tapered exterior surfaces with the depressions therein comprising a pair of shallow indentations. In said preferred reflector member construction, the recessed opening is also formed by spaced apart shoulders extending from the inner walls of said cavity and with both said recessed opening and the depressions which cooperate in providing the present improvement being formed when said reflector member is initially molded. Understandably, the presently improved lamp unit only further requires that protuberances be located in an otherwise conventional lamp socket member in order to physically mate with said molded depressions in the reflector member. Said presently improved lamp unit enables the modified reflector member to be physically supported so that the light source either projects illumination in a horizontal direction or be vertically supported so that the illumination is projected in a vertically downward direction.

BRIEF DESCRIPTIONS OF THE DRAWINGS

DESCRIPTION OF THE PREFERRED EMBODIMENTS

Figure 1:
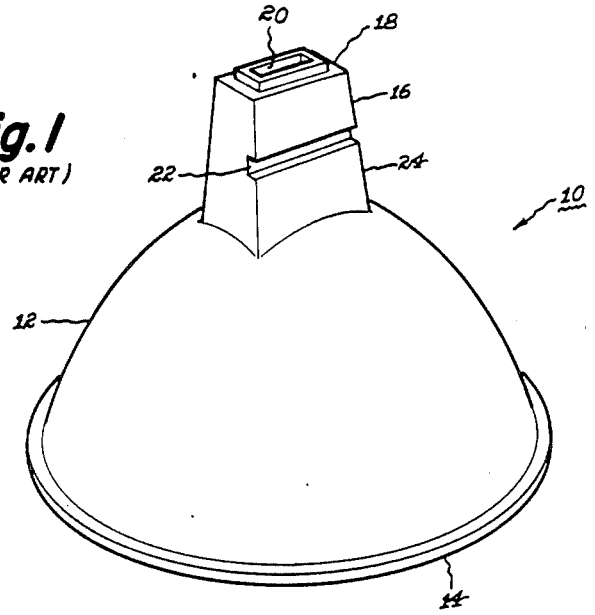
Fig. 1 (PRIOR ART)
FIG. 1 is a perspective view depicting a prior art lamp unit wherein the cavity end of the reflector member has been saw cut and fire polished while a horizontal slot helps physically retain said lamp unit in its socket.

Referring to FIG. 1, said prior art lamp unit 10 includes a molded or pressed glass reflector member 12 having a generally parabolic reflective surface 14 which terminates at its base end in a protruding elongated hollow cavity portion 16 that provides the structural means to physically engage said lamp unit in its socket. Said cavity 16 is originally molded with a closed end 18 and which is customarily saw cut to provide a smaller size opening 20 at the outermost end said cavity. Said outer-most end of the cavity can be optionally fire polished to remove flaws in the glass that might otherwise weaken the lamp unit during use and lead to its premature failure. A conventional tungsten halogen lamp (not shown) is inserted into the elongated hollow cavity portion of said reflector member so that its filiment light source which is generally a tungsten incandescent filament, resides at the focal point of the parabolic reflector surface. The customary method of providing said lamp assembly in the reflector member utilizes an adhesive cement to establish the desired lamp location after said lamp filament has been properly focused. A pair of lamp inlead wires project through the outermost opening at the base end of the reflector member for subsequent electrical connection to terminal elements in the socket member (not shown). A horizontal slot 22 is also provided on one of the flat tapered exterior sides 24 of said hollow cavity portion in the reflector member to help physically retain said lamp unit in its socket when engaged by a properly located protuberance in a socket member.

Figure 2:
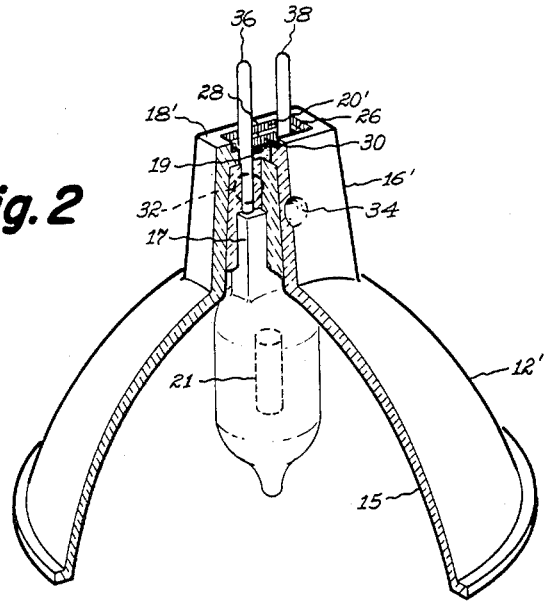
FIG. 2 is a perspective view of a glass reflector member modified in accordance with the present invention.

In FIG. 2 there is shown a partial view of the modified all glass reflector lamp unit constructed in accordance with the present invention. As shown, said lamp unit consists essentially of a molded glass reflector member 12' having a front concave reflecting portion 15 and terminating in an elongated hollow cavity portion 16' which protrudes rearwardly from said reflector member and with said hollow cavity portion having a tungsten halogen lamp 17 permanently attached thereto. Said tungsten halogen lamp is secured in the hollow opening with an adhesive lamp cement 19 so that its light source 21, which is generally a tungsten filament, resides at the focal point of the concave reflector member. The customary method of providing said lamp unit fixes the lamp component in place after said lamp filament has been properly focused with said cement serving as the sole support for said lamp in directly attaching said lamp to said reflector member. As further despicted in said drawing, said elongated hollow cavity portion 16' terminates at its rearmost end 18' in a smaller diameter opening 20' but which is now recessed to provide an engagement surface 26 serving to more accurately position the assembled lamp unit in a socket. Said recessed opening 20' can be formed with a continuous shoulder 28 bridging both inner walls of said elongated reflector cavity and which can be subsequently formed into an opening as hereinafter described. For example, said reflector member can be initially molded with the rearwardly extending cavity portion end being closed by said continuous shoulder and than hot punched to form a smaller size opening 30 defined in the spaced apart shoulder residue, all as described still more fully in the aforementioned U.S. Pat. No. 4,499,526 patent. Molded depressions 32 and 34 are also formed in said hollow cavity portion 16' when initally molded which cooperate with said engagement surface 26 in physically retaining the lamp unit within its socket as well as more accurately positioning the lamp filament therein. In said latter regard, it can be appreciated that having the molded depressions 32 and 34 located on opposing side of the hollow cavity portion 16' serves as an effective means to avert all movement of the lamp unit after its insertion into the lamp socket. Understandably, said lamp socket member includes properly located protuberances which physically engage these molded depressions to achieve the desired more accurate positioning as well as retention of the lamp unit. A pair of lamp inlead wires 36 and 38 are further secured in said lamp unit with the aforementioned adhesive cement and project through the outermost opening of said hollow cavity portion 16' for subsequent electrical connection to terminal elements in the socket member (not shown).

It will be apparent in the foregoing description that an improved reflector member construction has been provided which is generally useful for lamp units employing a tungsten halogen lamp as the light source. It is not intended to limit this improvement to specific embodiments above described, however, since it will also be apparent that modifications thereof are still within the scope and spirit of the present invention. For example, it is now known to provide a multi-faceted reflector surface in said reflector member utilizing a geometric mirror design optically producing a precise, broad, or narrow light beam pattern. Additionally, dichroic reflector coatings are also known for said type lamp unit to reduce heat through rear lamp emission of infrared rays. Accordingly, it is intended to limit the present invention only by the scope of the following claims:

What I claim as new and desire to secure by United States Letters Patent is:

1. An all glass lamp unit consisting essentially of (i) a molded glass reflector member having a front concave reflecting portion terminating in an elongated hollow cavity portion having inner and outer walls and which protrudes rearwardly from said reflector member, said elongated cavity portion terminating at its rearmost end in a recessed opening and having a foremost end which opens into said reflector portion wherein the opening in said rearmost end is smaller in size than the opening in said foremost end, said rearmost end comprising said recessed opening which is formed at said rearmost end by spaced apart shoulders extending from the inner walls of said cavity portion which, when said lamp unit is assembled, provides a recessed engagement surface for mounting said lamp unit, and (ii) a tungsten halogen lamp permanently secured in said hollow cavity portion with cement so that its light source is positioned at the focal point of said reflector member with lamp inleads projecting through said recessed opening, said cement serving as the sole support for said lamp in directly attaching said lamp to said reflector member, wherein the improvement comprises including additional molded depressions located on opposing exterior surfaces of said elongated cavity portion which cooperate with said recessed engagement surface to more accurately position and physically secure the lamp in use and with said entire cavity portion including said recessed engagement surface and additional molded depressions being formed when said reflector member is initially molded, wherein each of said molded depressions is in the form of a dimple and does not extend completely across the surface in which it is formed and located, thereby positively securing said unit from both longitudinal and transverse movement when secured by said depressions in a lamp mount.

2. A lamp unit as in claim 1 wherein said reflector member has a parabolic shape.

3. A lamp unit as in claim 1 wherein said recessed opening is formed as a single slot through which a pair of lamp inlead wires project.

4. A lamp unit as in claim 1 wherein said elongated cavity portion includes flat tapered exterior surfaces and said depressions comprise a pair of shallow indentations molded in said flat surfaces.

5. A lamp unit as in claim 1 wherein said depressions serve to secure said lamp in a lamp mount.

6. The lamp unit of claim 4 secured wherein said depressions serve to secure said lamp unit in a lamp mount.

7. The lamp unit of claim 6 mounted in a lamp mount and secured therein by said depressions and oriented so that its light is projected in a vertically downward direction.

* * * * *